US007563752B2

(12) United States Patent
Yagishita

(10) Patent No.: US 7,563,752 B2
(45) **Date of Patent: *Jul. 21, 2009**

(54) LUBRICATING OIL COMPOSITIONS

(75) Inventor: Kazuhiro Yagishita, Yokohama (JP)

(73) Assignee: Nippon Oil Corporation, Tokyo (JP)

( * ) Notice: Subject to any disclaimer, the term of this patent is extended or adjusted under 35 U.S.C. 154(b) by 505 days.

This patent is subject to a terminal disclaimer.

(21) Appl. No.: 11/048,441

(22) Filed: Feb. 1, 2005

(65) Prior Publication Data

US 2005/0130854 A1 Jun. 16, 2005

Related U.S. Application Data

(63) Continuation of application No. PCT/JP03/09884, filed on Aug. 4, 2003.

(30) Foreign Application Priority Data

Aug. 5, 2002 (JP) ..... 2002-227484

(51) Int. Cl.
*C10M 159/22* (2006.01)

(52) U.S. Cl. ..... 508/460; 508/376; 508/371

(58) Field of Classification Search ..... 508/175, 508/440, 460, 376, 371
See application file for complete search history.

(56) References Cited

U.S. PATENT DOCUMENTS

| | | | | | |
|---|---|---|---|---|---|
| 4,280,916 | A | * | 7/1981 | Richards et al. | 508/291 |
| 4,612,129 | A | | 9/1986 | DiBiase et al. | |
| 5,380,508 | A | * | 1/1995 | Inoue | 423/286 |
| 5,415,792 | A | * | 5/1995 | Campbell | 508/459 |
| 5,415,793 | A | * | 5/1995 | Nassry et al. | 508/377 |
| 5,498,809 | A | * | 3/1996 | Emert et al. | 585/13 |
| 5,567,342 | A | * | 10/1996 | Inoue et al. | 508/287 |
| 5,652,201 | A | * | 7/1997 | Papay et al. | 508/228 |
| 5,670,464 | A | * | 9/1997 | Kita et al. | 508/562 |
| 6,159,911 | A | * | 12/2000 | Katafuchi | 508/391 |

FOREIGN PATENT DOCUMENTS

| | | | |
|---|---|---|---|
| EP | 0 234 923 | A2 | 9/1987 |
| EP | 0 243 026 | A2 | 10/1987 |
| EP | 0 280 579 | A2 | 8/1988 |
| EP | 0 280 580 | A2 | 8/1988 |
| EP | 0 953 629 | A1 | 11/1999 |
| EP | 1 018 539 | A2 | 7/2000 |
| EP | 1 227 145 | A1 | 7/2002 |
| GB | 1146925 | | 3/1969 |
| GB | 1184020 | | 3/1970 |
| JP | 48-35325 | | 10/1973 |
| JP | 50-3082 | | 1/1975 |
| JP | 52-704 | | 1/1977 |
| JP | 62-501572 | A | 6/1987 |
| JP | 62-501917 | A | 7/1987 |
| JP | 62-243692 | A | 10/1987 |
| JP | 62-253691 | A | 11/1987 |
| JP | 63-304095 | A | 12/1988 |
| JP | 63-304096 | A | 12/1988 |
| JP | 1-500912 | A | 3/1989 |
| JP | 06-041568 | A | 2/1994 |
| JP | 07-150169 | A | 6/1995 |
| JP | 08-048989 | A | 2/1996 |
| JP | 08-253782 | A | 10/1996 |
| JP | 09-111275 | A | 4/1997 |
| JP | 11-302679 | A | 11/1999 |
| JP | 2000-063862 | A | 2/2000 |
| JP | 2000-256690 | A | 9/2000 |
| JP | 2002-212579 | A | 7/2002 |
| JP | 2002-294271 | A | 10/2002 |
| JP | 2003-183686 | A | 7/2003 |
| JP | 2003-277781 | A | 10/2003 |
| JP | 2003-277782 | A | 10/2003 |
| JP | 2003-277783 | A | 10/2003 |
| JP | 2004-035619 | A | 2/2004 |
| JP | 2004-035620 | A | 2/2004 |
| JP | 2004-083891 | A | 3/2004 |
| WO | WO 86/06739 | A1 | 11/1986 |
| WO | WO 88/02771 | A1 | 4/1988 |
| WO | WO 94/28094 | A1 | 12/1994 |
| WO | 96 37582 | A1 | 11/1996 |
| WO | WO 2004/003118 | A1 | 1/2004 |

* cited by examiner

*Primary Examiner*—Glenn Caldarola
*Assistant Examiner*—Jim Goloboy
(74) *Attorney, Agent, or Firm*—Panitch Schwarze Belisario & Nadel LLP

(57) ABSTRACT

Disclosed are lubricating oil compositions comprising a lubricating base oil, (A) a specific alkali metal or alkaline earth metal salicylate and/or an overbased or basic salt thereof in an amount of 0.005 to 5 percent by mass in terms of metal, (B) a phosphorus-containing anti-wear agent in an amount of 0.005 to 0.2 percent by mass in terms of phosphorus, (C) an amide compound in an amount of 0.01 to 1 percent by mass and containing sulfur in a total amount of 0.3 percent by mass or less, based on the total mass of the composition. The lubricating oil compositions are low sulfur lubricating oils which are extremely excellent in anti-wear properties and long drain properties and suitable particularly for an internal combustion engine.

13 Claims, No Drawings

LUBRICATING OIL COMPOSITIONS

CROSS-REFERENCE TO RELATED APPLICATION

This application is a continuation of International Application No. PCT/JP2003/09884, filed Aug. 4, 2003, which was published in the Japanese language on Feb. 12, 2004, under International Publication No. WO 2004/0013265 A1, the disclosure of which is incorporated herein by reference.

FIELD OF THE INVENTION

The present invention relates to low sulfur lubricating oil compositions and more particularly to those with excellent anti-wear properties and long drain properties, suitable for internal combustion engines.

BACKGROUND OF THE INVENTION

Sulfur- and phosphorus-containing additives such as zinc dialkyldithiophosphates, with excellent anti-wear and anti-oxidation properties have been used as substantially essential additives for conventional lubricating oils, particularly those for internal combustion engines. However, the lubricating oils have been strongly required to contain more less sulfur, phosphorus and ash as a result of necessity to alleviate harmful influences on exhaust-gas purifying catalysts such as ternary catalysts, oxidation catalysts and NOx adsorbers, or exhaust-gas after-treatment devices such as diesel particulate filters (DPF), which are equipped in internal combustion engines in conformity with recent environment-related issues.

Examples of low phosphorus or phosphorus free oils which have been disclosed so far include those described in Japanese Patent Laid-Open Publication Nos. 62-253691, 1-500912, 6-41568, 63-304095, 63-304096, 52-704, 62-243692, 62-501917, 62-501572, and 2000-63862. Examples of low ash oils include those described in Japanese Patent Laid-Open Publication Nos. 8-48989, 8-253782, 9-111275, and 2000-256690. However, when these known oils contain decreased or no zinc dithiophosphate, they need to be blended with a sulfur-containing compound for maintaining their anti-wear properties, while the low ash oils contain zinc dithiophosphate necessarily. So far there have been discovered few lubricating oils having excellent anti-wear properties and decreased in sulfur, phosphorus, and ash contents.

The present inventor found that low sulfur lubricating oil compositions containing a phosphorus-containing compound such as zinc mono- or di-alkylphosphtes, zinc dialkylmonothiophosphates or phosphoric acid triesters exhibited more excellent low friction properties, high temperature detergency, oxidation stability, and base number retention properties while maintaining anti-wear properties, than those containing zinc dithiophosphate only and have filed patent applications for such low sulfur lubricating oil compositions (Japanese Patent Application Nos. 2002-015351, 2001-315941, 2002-086145, 2002-086146, 2002-086147, 2002-191090, 2002-191091, and 2002-191092). However, in the case of using a salicylate-based detergent whose metal ratio is 5 or less, particularly that whose metal ratio is adjusted to be 3 or less, as a metallic detergent, a composition can be obtained which is extremely excellent in low friction properties, high temperature detergency, oxidation stability, and base number retention properties. However, it was found out that when the content of a sulfur- and phosphorus-containing anti-wear agent such as zinc dithiophosphate is decreased or a sulfur-free phosphorus-containing anti-wear agent is used, for decreasing the sulfur content, the resulting composition would not be able to exhibit sufficiently anti-wear properties for the valve train of an internal combustion engine, such as anti-scuffing properties for rocker arm pads and anti-wear properties for cams.

The present invention was made in view of the foregoing circumstances and intends to provide a long drain type low sulfur lubricating oil composition containing a salicylate-based detergent and having excellent anti-wear properties.

BRIEF SUMMARY OF THE INVENTION

As a result of extensive studies, the present invention was achieved by finding that a low sulfur lubricating oil composition containing a specific salicylate-based detergent, a phosphorus-containing anti-wear agent, and a amide compound was able to solve the above-mentioned problems.

That is, the present invention relates to a lubricating oil composition comprising a lubricating base oil, (A) an alkali metal or alkaline earth metal salicylate containing at least one type of compound selected from those represented by formula (1) below and/or an overbased or basic salt thereof in an amount of 0.005 to 5 percent by mass in terms of metal, (B) a phosphorus-containing anti-wear agent in an amount of 0.005 to 0.2 percent by mass in terms of phosphorus, and (C) an amide compound represented by formula (2) in an amount of 0.01 to 1 percent by mass and containing sulfur in a total amount of 0.3 percent by mass or less, based on the total mass of the composition:

(1)

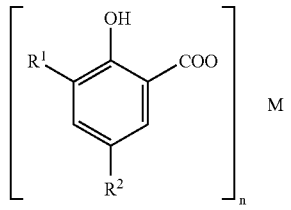

wherein $R^1$ is a hydrocarbon group having 1 to 40 carbon atoms, $R^2$ is hydrogen or a hydrocarbon group having 1 to 40 carbon atoms, which hydrocarbon groups may contain oxygen or nitrogen, M is an alkali metal or alkaline earth metal, and n is an integer of 1 or 2 depending on the valence of the metal; and (2)

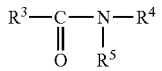

wherein $R^3$ is a hydrocarbon group having 6 to 40 carbon atoms, and $R^4$ and $R^5$ may be the same or different and are each independently hydrogen or a hydrocarbon group having 1 to 40 carbon atoms.

Component (A) is preferably one or a mixture of two or more types of compounds selected from the group consisting of (A-1) an alkali metal or alkaline earth metal salicylate wherein the component ratio of the monoalkylsalicylate having one secondary alkyl group having 10 to 40 carbon atoms is 85 percent by mol or more wherein the component ratio of a compound represented by formula (1) wherein $R^1$ is a secondary alkyl group having 10 to 40 carbon atoms and $R^2$ is hydrogen is 40 percent by mol or more, and/or an (overbased) basic salt thereof; (A-2) an alkali metal or alkaline earth metal salicylate represented by formula (1) wherein $R^1$ and $R^2$are secondary alkyl groups having 10 to 40 carbon atoms, and/or an (overbased) basic salt thereof; and (A-3) an alkali metal or alkaline earth metal salicylate represented by formula (1) wherein either one of $R^1$ or $R^2$is a hydrocarbon group having one or more but fewer than 10 carbon atoms and the other is a secondary alkyl group having 10 to 40 carbon atoms, and the difference of carbon number between $R^1$ and $R^2$ is 10 or more, and/or an (overbased) basic salt thereof.

The secondary alkyl group having 10 to 40 carbon atoms of Component (A-1)is preferably that having 10 or more but fewer than 20 carbon atoms.

The metal ratio of Component (A) is preferably 2.3 or less.

The metal ratio of Component (A) is preferably 3 or more.

Component (B) is preferably at least one compound selected from the group consisting of phosphorus compounds represented by formulas (3) and (4), and metal or amine salts thereof:

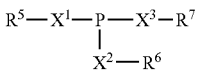

(3)

wherein $X^1$, $X^2$, and $X^3$ are each independently oxygen or sulfur, and $R^5$, $R^6$, and $R^7$ are each independently hydrogen or a hydrocarbon group having 1 to 30 carbon atoms; and

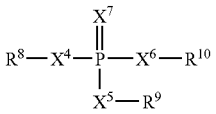

(4)

wherein $X^4$, $X^5$, $X^6$, and $X^7$ are each independently oxygen or sulfur, and $R^8$, $R^9$, and $R^{10}$ are each independently hydrogen or a hydrocarbon group having 1 to 30 carbon atoms.

Component (B) is preferably at least one type of compound selected from the group consisting of metal salts of phosphorus compounds of formula (3) wherein all of $X^1$, $X^2$, and $X^3$ are oxygen and of formula (4) wherein all of $X^4$, $X^5$, $X^6$, and $X^7$ are oxygen.

Component (B) is preferably a phosphorus compound of formula (4) wherein all of $X^4$, $X^5$, $X^6$, and $X^7$are oxygen, and $R^8$, $R^9$, and $R^{10}$ are each independently a hydrocarbon group having 1 to 30 carbon atoms.

Component (B) is preferably a zinc salt of a phosphorus compound of formula (4) wherein any two of $X^4$, $X^5$, $X^6$, and $X^7$ are oxygen, and two of $R^8$, $R^9$, and $R^{10}$ are each independently a hydrocarbon group having 1 to 30 carbon atoms and the other is hydrogen.

The lubricating oil composition contains Component (B) in an amount of 0.08 percent by mass in terms of phosphorus, based on the total mass of the composition.

The lubricating oil composition preferably contains at least one additive selected from the group consisting of (D) ashless dispersants and (E) anti-oxidants.

The total sulfur content of the lubricating base oil is 0.05 percent by mass or less.

The lubricating oil composition is preferably used for an internal combustion engine.

The sulfated ash content of the lubricating oil composition is preferably 1.0 percent by mass or less.

The lubricating oil composition preferably fulfills one or more requirements selected from those wherein the sulfated ash content is 0.5 percent by mass or less, the total sulfur content is 0.05 percent by mass or less, and the phosphorus content is 0.05 percent by mass or less.

The present invention also relates to a method for preventing the valve train of an internal combustion engine from wearing using the lubricating oil composition.

DETAILED DESCRIPTION OF THE INVENTION

The lubricating oil composition will be described in more detail below.

No particular limitation is imposed on lubricating base oils used in the present invention. Therefore, any conventional mineral and synthetic base oils used for lubricating oils may be used.

Specific examples of mineral base oils include those which can be obtained by subjecting a lubricating oil fraction produced by vacuum-distilling a topped crude resulting from atmospheric distillation of a crude oil, to any one or more treatments selected from solvent deasphalting, solvent extraction, hydrocracking, solvent dewaxing, and hydrorefining; wax-isomerized mineral oils; and those obtained by isomerizing GTL WAX (Gas to Liquid Wax).

No particular limitation is imposed on the sulfur content of mineral base oils as long as the total sulfur content of the composition is 0.3 percent by mass or less. The sulfur content of mineral oils is preferably 0.05 percent by mass or less, more preferably 0.01 percent by mass or less, and particularly preferably 0.005 percent by mass or less. A lubricating oil composition with more excellent long drain properties can be obtained by decreasing the sulfur content of a mineral base oil. When such a lubricating oil composition is used for an internal combustion engine, it can avoid harmful influences on exhaust-gas after treatment devices as much as possible.

Although no particular limitation is imposed on the total aromatic content of mineral base oils, it is preferably 10 percent by mass or less, more preferably 6 percent by mass or less, further more preferably 3 percent by mass or less, and particularly preferably 2 percent by mass or less. A lubricating oil composition with more excellent oxidation stability can be obtained by decreasing the total aromatic content of a base oil to 10 percent by mass or less.

The term "total aromatic content" used herein denotes an aromatic fraction content determined in accordance with ASTM D2549. The aromatic fraction includes alkylbenzenes; alkylnaphthalens; anthracene, phenanthrene, and alkylated products thereof; compounds wherein four or more benzene rings are condensated to each other; and compounds having heteroaromatics such as pyridines, quinolines, phenols, and naphthols.

Specific examples of synthetic base oils include polybutenes and hydrides thereof; poly-α-olefins such as 1-octene oligomer and 1-decene oligomer, and hydrides thereof; diesters such as ditridecyl glutarate, di-2-ethylhexyl adipate, diisodecyl adipate, ditridecyl adipate, and di-2-ethylhexyl cebacate; polyol esters such as neopentyl glycol ester, trimethylolpropane caprylate, trimethylolpropane pelargonate, pentaerythritol-2-ethyl hexanoate, and pentaerythritol pelargonate; aromatic synthetic oils such as alkylnaphthalenes, alkylbenzenes, and aromatic esters; and mixtures thereof.

Any one of the above-described mineral base oils or synthetic base oils or any mixture of two or more types selected from these base oils may be used in the present invention. For example, the base oil used in the present invention may be one or more of the mineral base oils or synthetic base oils or a mixed oil of one or more of the mineral base oils and one or more of the synthetic base oils.

Although no particular limitation is imposed on the kinematic viscosity at 100° C. of the lubricating base oil used in the present invention, it is preferably 20 $mm^2/s$ or lower, more preferably 10 $mm^2/s$ or lower, and preferably 1 $mm^2/s$ or higher, more preferably 2 $mm^2/s$ or higher. A lubricating base oil with a kinematic viscosity at 100° C. exceeding 20 $mm^2/s$ is not preferred because the low temperature viscosity characteristics of the resulting lubricating oil composition would be deteriorated, while that with a kinematic viscosity at 100° C. of less than 1 $mm^2/s$ is not also preferred because the resulting lubricating oil composition would be poor in lubricity due to its insufficient oil film formation capability at lubricated sites and large in evaporation loss of the base oil.

The evaporation loss of the base oil used in the present invention is preferably 20 percent by mass or less, more preferably 16 percent by mass or less, and particularly preferably 10 percent by mass or less, as measured by NOACK evaporation analysis. A lubricating base oil with a NOACK evaporation loss exceeding 20 percent by mass is not preferred because the resulting lubricating oil composition would be large in evaporation loss of the base oil and the sulfur compounds, phosphorus compounds or metals in the composition would accumulate on an exhaust gas purifying device together with the base oil if the composition is used as an internal combustion engine lubricating oil and thus would adversely affect the exhaust gas purifying performance. The term "NOACK evaporation" used herein is defined as the amount of a sample lubricating oil of 60 g, which is lost when the oil is retained at a temperature of 250° C. and a pressure of 20 mm $H_2O$ (196 Pa) for one hour in accordance with ASTM D 5800.

Although no particular limitation is imposed on the viscosity index of the lubricating base oil used, it is preferably 80 or higher, more preferably 100 or higher, and further more preferably 120 or higher so as to be able to obtain excellent viscosity characteristics ranging from low temperatures to high temperatures. A lubricating base oil with a viscosity index of less than 80 is not preferred because the low temperature viscosity characteristics of the resulting lubricating oil composition would be deteriorated.

Component (A) of the lubricating oil composition of the present invention is an alkali metal or alkaline earth metal salicylate containing at least one type of compound selected from those represented by formula (1) and overbased or basic salts thereof:

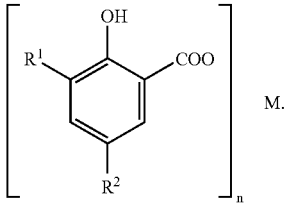

(1)

In formula (1), $R^1$ is a hydrocarbon group having 1 to 40 carbon atoms, $R^2$ is hydrogen or a hydrocarbon group having 1 to 40 carbon atoms, which hydrocarbons may contain oxygen or nitrogen, M is an alkali metal such as sodium and potassium or an alkaline earth metal such as magnesium, barium, and calcium, and preferably magnesium and/or calcium, and n is an integer of 1 or 2 depending on the valence of the metal "M".

Examples of the hydrocarbon group having 1 to 40 carbon atoms include alkyl, cycloalkyl, alkenyl, alkyl-substituted cycloalkyl, aryl, alkyl-substituted aryl, and arylalkyl groups. More specific examples include straight-chain or branched alkyl groups having 1 to 40 carbon atoms, such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl, and triacontyl groups; cycloalkyl groups having 5 to 7 carbon atoms, such as cyclopentyl, cyclohexyl, and cycloheptyl groups; alkylcycloalkyl groups having 6 to 10 carbon atoms, such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, and methylethylcycloheptyl groups, of which the alkyl groups may bond to any position of the cycloalkyl groups; straight-chain or branched alkenyl groups such as butenyl, pentenyl, hexenyl, heptenyl, octenyl, noneyl, decenyl, undecenyl, dodecenyl, tridecenyl, tetradecenyl, pentadecenyl, hexadecenyl, heptadecenyl, octadecenyl and nonadecenyl groups, the position of which the double bonds may vary; aryl groups such as phenyl and naphtyl groups; alkylaryl groups having 7 to 10 carbon atoms, such as tolyl, xylyl, ethylphenyl, propylphenyl, and butylphenyl groups, of which the alkyl groups may be straight-chain or branched and may bond to any position of the aryl groups; and arylalkyl groups having 7 to 10 carbon atoms, such as benzyl, phenylethyl, phenylpropyl, and phenylbutyl groups, of which the alkyl groups may be straight-chain or branched. These hydrocarbon groups may contain oxygen or hydrogen.

In the present invention, with regard to the hydrocarbon groups having 1 to 40 carbon atoms, they are preferably secondary alkyl groups having 10 to 40 carbon atoms, derived from polymers or copolymers of ethylene, propylene, or 1-butene and particularly preferably secondary alkyl groups having 14 to 19 or 20 to 26 carbon atoms.

Component (A) is preferably one or a mixture of two or more types of compounds selected from the group consisting of the following alkali metal or alkaline earth metal salicylates (A-1) to (A-3):

(A-1) an alkali metal or alkaline earth metal salicylate wherein the component ratio of the monoalkylsalicylate having one secondary alkyl group having 10 to 40 carbon atoms is 85 percent by mol or more wherein the component ratio of the compound represented by formula (1) wherein $R^1$ is a secondary alkyl group having 10 to 40 carbon atoms and $R^2$ is hydrogen is 40 percent by mol or more, and/or an (overbased) basic salt thereof;

(A-2) an alkali metal or alkaline earth metal salicylate represented by formula (1) wherein $R^1$ and $R^2$ are secondary alkyl groups having 10 to 40 carbon atoms, and/or an (overbased) basic salt thereof; and (A-3) an alkali metal or alkaline earth metal salicylate represented by formula (1) wherein either one of $R^1$ or $R^2$ is a hydrocarbon group having 1 to 9 carbon atoms and the other is a secondary alkyl group having 10 to 40 carbon atoms, and the difference of carbon number between $R^1$ and $R^2$ is 10 or more, and/or an (overbased) basic salt thereof.

The component ratio of the monoalkylsalicylate in Component (A-1) is 85 percent by mol or more and preferably 88 percent by mol or more and may be 100 percent by mol or may be even 95 percent by mol or less in view of the production cost. The monoalkylsalicyalte is composed of a 3-alkylsalicylate, a 4-alkylsalicylate, and a 5-alkylsalicylate. However, in the present invention, the component ratio of the 3-alkylsalicylate (compound represented by formula (1) wherein $R^1$ is a secondary alkyl group having 10 to 40 carbon atoms and $R^2$ is hydrogen) in the salicylate of Component (A-1) is 40 percent by mol or more, preferably 50 percent by mol or more, and more preferably 60 percent by mol or more and may be 100 percent by mol but even may be 95 percent by mole or less in view of the production cost. When the component ratio of the 3-alkylsalicylate is 80 percent by mol or less, 60 percent by mol or less, or particularly 55 percent by mol or less and particularly $R^1$ is a secondary alkyl group having fewer than 20 carbon atoms, the resulting composition would not exhibit sufficiently anti-wear properties such as anti-scuffing properties for rocker arms and anti-wear properties for cams, in an internal combustion engine, if Component (C) hereinafter described is not used, depending on the selection or decrease of Component (B). The component structure of the lubricating oil composition of the present invention is thus effective because these anti-wear properties are extremely improved using Component (C) in combination. The higher the component ratio of the 3-alkylsalicylate is, the anti-wear properties are more improved by increasing the carbon number of the secondary alkyl group to 20 or more even not using Component (C). However, the content of Component (B) can be further decreased to for example 0.05 percent by mass or less in terms of phosphorus, using Component (C) in combination. Component (A-1) whose component ratio of the 3-alkylsalicylate is less than 40 percent by mol is not preferred because the component ratio of the 5-alkylsalicylate is relatively increased and thus the resulting composition becomes poor in solubility in a base oil.

In Component (A-2), $R^1$ and $R^2$ are secondary alkyl groups having 10 to 40 carbon atoms and may be the same or different from each other but are preferably secondary alkyl groups derived from the same olefin in view of the production. When Component (A-2) is used alone, a composition with excellent anti-wear properties can be obtained without using Component (C) However, the use of Component (C) is preferred because the content of Component (B) can be further decreased to for example 0.05 percent by mass or less in terms of phosphorus. When Components (A-1) and (A-2) are used in combination, it is preferred that the component ratio of (A-2) be adjusted to be 10 percent by mol or more, preferably 20 percent by mol or more, and particularly preferably 40 percent by mol or more with the objective of the further improvement of the anti-wear properties of the resulting lubricating oil composition.

In Component (A-3), the difference of carbon number between $R^1$ and $R^2$ is 10 or more, either one of them is a hydrocarbon group having one or more but fewer than 10 carbon atoms, preferably a hydrocarbon group having 1 to 5 carbon atoms, more preferably an alkyl group such as methyl and tertiary butyl groups, and particularly preferably a methyl group and the other is a secondary alkyl group having 10 to 40 carbon atoms and preferably a secondary alkyl group having 10 to 30 carbon atoms, and most preferably $R^1$ is a secondary alkyl group having 10 to 40 carbon atoms and $R^2$ is a hydrocarbon group having one or more but fewer than 10 carbon atoms. The hydrocarbon group having 1 to 10 carbon atoms may contain oxygen or nitrogen and thus may be a carboxyl group, i.e., —COOH group derived from a carboxylic acid having one or more but fewer than 10 carbon atoms. When Component (A-3) is used alone, a lubricating oil composition with excellent anti-wear properties can be obtained even without using Component (C) . The use of Component (C) is preferred because the content of Component (B) can be further decreased to for example 0.05 percent by mass or less in terms of phosphorus. When Components (A-1) and (A-3) are used in combination, the component ratio of (A-3) is adjusted to be 10 percent by mol or more, preferably 20 percent by mol or more, and particularly preferably 30 percent by mol or more with the objective of the further improvement of anti-wear properties.

When Components (A-1) to (A-3) are used in combination, the total component ratio of the salicylates having a substituent at least at the 3-position is preferably 55 percent by mol or more, more preferably 65 percent by mol or more, and particularly preferably 70 percent by mol or more.

No particular limitation is imposed on the method of producing Component (A), which thus may be produced by any of known methods. For example, an alkylsalicylic acid containing a monoalkylsalicylic acid as the main component is obtained by alkylating 1 mol of a phenol using 1 mol of an olefin such as an ethylene polymer having 10 to 40 carbon atoms, followed by carboxylation using carbon dioxide gas or alternatively by alkylating 1 mol of a salicylic acid using 1 mol of the above olefin. The alkylsalicylic acid is then reacted with an metal base such as an alkali metal or alkaline earth metal oxide or hydroxide or converted to an alkali metal salt such as sodium salt or potassium salt, which may be further substituted with an alkaline earth metal, thereby obtaining Component (A).

Components (A-2) and (A-3) may be produced by any of known methods as disclosed in Japanese Patent Publication Nos. 48-35325 and 50-3082.

Specifically, Component (A-2) may be obtained by the above-described method for Component (A-1) wherein, however, 1.1 to 4 mol, preferably 2 to 3 mol, and particularly preferably 2 to 2.5 mol of a phenol is used instead of 1 mol of a phenol.

Specifically, Component (A-3) may be the following method. The starting material such as orthocresol or paracresol, or ortho-t-butylphenol or para-t-butylphenol is alkylated selectively at the para- or ortho-position using an olefin such as an ethylene polymer having 10 to 40 carbon atoms and preferably 10 to 30 carbon atoms so as to obtain 3-methyl-5-alkylphenol or 3-alkyl-5-methylphenol, or 3-t-butyl-5-alkylphenol or 3-alkyl-5-t-butylphenol, which is then carboxylated using carbon dioxide gas, thereby obtaining an alkylsalicylic acid. Thereafter, the alkylsalicylic acid is reacted with a metal base such as an alkali metal or alkaline earth metal oxide or hydroxide or converted to an alkali metal salt such as sodium and potassium salts, which alkali metal salt may be further substituted with an alkaline earth metal thereby obtaining Component (A-3).

Examples of Component (A) of the present invention also include basic salts obtained by heating the above-described alkali metal or alkaline earth metal salicylates (neutral salts) with an excess amount of an alkali metal or alkaline earth metal salt or an alkali metal or alkaline earth metal base (alkali metal or alkaline earth metal hydroxide or oxide) in the presence of water; and overbased salts obtained by reacting these neutral salts with a base such as an alkali metal or alkaline earth metal hydroxide in the presence of carbon dioxide gas, boric acid or borate.

These reactions are generally carried out in a solvent (aliphatic hydrocarbon solvents such as hexane, aromatic hydrocarbon solvents such as xylene, and light lubricating base oil).

It is preferred to use compounds whose metal content is within the range of 1.0 to 20 percent by mass and preferably 2.0 to 16 percent by mass.

In the present invention, the base number of Component (A) is usually from 0 to 500 mg KOH/g and preferably 20 to 450 mg KOH/g. Component (A) may be a mixture of one or more types of those whose base number is within these ranges. The term "base number" used herein denotes a base number measured by the perchloric acid potentiometric titration method in accordance with section 7 of JIS K2501 "Petroleum products and lubricants-Determination of neutralization number".

No particular limitation is imposed on the metal ratio of Component (A). Generally, one or more types of those with a metal ratio of 20 or less may be used. It is particularly preferred to use a salicylate whose metal ratio is 5 or less, preferably 3 or less, more preferably 2.3 or less, and particularly preferably 1.5 or less with the objective of excellent oxidation stability, high temperature detergency, and low friction properties. When Component (A-1) with ametal ratio of 5 or less, particularly 3 or less and one secondary alkyl group having fewer than 20 carbon atoms is used, the resulting composition would not exhibit sufficiently anti-wear properties as described above if not contain Component (C). Therefore, the composition containing Component (A-1). in combination with Component (C) is extremely useful. It is interesting to note that a composition containing Component (A-1) whose metal ratio is 2.3 or less or 3 or more and particularly having a secondary alkyl group having fewer than 20 carbon atoms can exhibit more excellent anti-wear properties than that containing Component (A-1) with a metal ratio of 2.4 to 2.9.

The term "metal ratio" used herein is represented by "valence of metal element×metal element content (mol %)/soap group content (mol %) in a salicylate-based detergent" wherein the metal element is calcium, magnesium, or the like and the soap group is a salicylic acid group, or the like.

In the present invention, the upper limit content of Component (A) is 5 percent by mass or less, preferably 1 percent by mass or less, more preferably 0.4 percent by mass or less in terms of metal based on the total mass of the composition. Furthermore, in order to decrease the sulfated ash content of a composition to 1.0 percent by mass or less, the content of Component (A) is preferably 0.3 percent by mass or less. When the lubricating oil composition of the present invention is used for an internal combustion engine equipped with an exhaust-gas after-treatment device, the content of Component (A) is 0.2 percent by mass or less, preferably 0.15 percent by mass or less, and most preferably 0.10 percent by mass or less so as to avoid harmful influences on the device as much as possible thereby obtaining a lubricating oil composition whose sulfated ash content is 0.5 percent by mass or less. The lower limit content of Component (A) is 0.005 percent by mass or more, preferably 0.01 percent bymass or more, more preferably 0.02 percent by mass or more, and particularly preferably 0.05 percent by mass or more in terms of metal based on the total mass of the composition. Component (A) exceeding the above-described upper limit increase the sulfated ash content of the composition and may adversely affect the exhaust-gas after-treatment device of an internal combustion engine when the composition is used therefor. Component (A) of less than the above-described lower limit can not exhibit its basic performance characteristics as a metallic detergent, resulting in a lubricating oil composition which fails to exhibit high temperature detergency and long drain properties such as oxidation stability and base number retention properties. The sulfated ash content used herein is a value measured by a method described by "Testing Methods for Sulfated Ash" stipulated in JIS K 2272 5. and mainly results from metal-containing additives.

Components (B) of the present invention are phosphorus-containing anti-wear agents. No particular limitation is imposed on such anti-wear agents as long as they contain phosphorus in their molecules.

Component (B) is preferably at least one type of compound selected from the group consisting of phosphorus compounds represented by formulas (3) and (4), and metal salts and amine salts thereof:

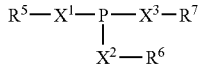

(3)

wherein $X^1$, $X^2$, and $X^3$ are each independently oxygen or sulfur, and $R^5$, $R^6$, and $R^7$ are each independently hydrogen or a hydrocarbon group having 1 to 30 carbon atoms; and

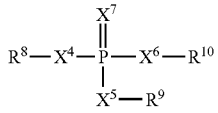

(4)

wherein $X^4$, $X^5$, $X^6$, and $X^7$ are each independently oxygen or sulfur, and $R^8$, $R^9$, and $R^{10}$ are each independently hydrogen or a hydrocarbon group having 1 to 30 carbon atoms.

Examples of the hydrocarbon groups having 1 to 30 carbon atoms for $R^5$ to $R^{10}$ include alkyl, cycloalkyl, alkenyl, alkyl-substituted cycloalkyl, aryl, alkyl-substituted aryl, and arylalkyl groups.

Examples of the alkyl group include straight-chain or branched alkyl groups such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, and octadecyl groups.

Examples of the cycloalkyl group include those having 5 to 7 carbon atoms, such as cyclopentyl, cyclohexyl, and cycloheptyl groups. Examples of the alkylcycloalkyl groups include those having 6 to 11 carbon atoms, such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl, and diethylcycloheptyl groups, of which the alkyl groups may bond to any position of the cycloalkyl groups.

Examples of the alkenyl group include straight-chain or branched alkenyl groups such as butenyl, pentenyl, hexenyl, heptenyl, octenyl, nonenyl, decenyl, undecenyl, dodecenyl, tridecenyl, tetradecenyl, pentadecenyl, hexadecenyl, heptadecenyl, and octadecenyl groups, the position of which the double bonds may vary.

Examples of the aryl group include phenyl and naphtyl groups. Examples of the alkylaryl group include those having 7 to 18 carbon atoms, such as tolyl, xylyl, ethylphenyl, propylphenyl, butylphenyl, pentylphenyl, hexylphenyl, heptylphenyl, octylphenyl, nonylphenyl, decylphenyl, undecylphenyl, and dodecylphenyl groups, of which the alkyl groups may be straight-chain or branched and may bond to any position of the aryl groups.

Examples of the arylalkyl groups include those having 7 to 12 carbon atoms, such as benzyl, phenylethyl, phenylpropyl, phenylbutyl, phenylpentyl, and phenylhexyl groups, of which the alkyl groups may be straight-chain or branched.

Hydrocarbon groups having 1 to 30 carbon atoms for $R^5$ to $R^{10}$ are preferably alkyl groups having 1 to 30 carbon atoms or aryl groups having 6 to 24 carbon atoms, more preferably alkyl groups having 3 to 18 carbon atoms, and further more preferably alkyl groups having 4 to 12 carbon atoms.

Examples of phosphorus compounds represented by formula (3) include phosphorous acid; monothiophosphorus acid; dithiophosphorus acid; trithiophosphorus acid; phosphorus acid monoesters, monothiophosphorus acid monoesters, dithiophosphorus acid monoesters, and trithiophosphorus acid monoesters, each having one of the above-described hydrocarbon groups having 1 to 30 carbon atoms; phosphorus acid diesters, monothiophosphorus acid diesters, dithiophosphorus acid diesters, and trithiophosphorus acid diesters, each having two of the above-described hydrocarbon groups having 1 to 30 carbon atoms; phosphorus acid triesters, monothiophosphorus acid triesters, dithiophosphorus acid triesters, and trithiophosphorus acid triesters, each having three of the above-described hydrocarbon groups having 1 to 30 carbon atoms; and mixtures thereof.

In the present invention, preferably two or more and particularly preferably all of $X^1$ to $X^3$ in formula (3) are oxygen with the objective of further enhancement of high temperature detergency and long drain properties such as oxidation stability and base number retention properties.

Examples of phosphorus compounds represented by formula (4) include phosphoric acid; monothiophosphoric acid; dithiophosphoric acid; trithiophosphoric acid; tetrathiophosphoric acid; phosphoric acid monoesters, monothiophosphoric acid monoesters, dithiophosphoric acid monoesters, trithiophosphoric acid monoesters, and tetrathiophosphoric acid monoesters, each having one of the above-described hydrocarbon groups having 1 to 30 carbon atoms; phosphoric acid diesters, monothiophosphoric acid diesters, dithiophosphoric acid diesters, trithiophosphoric acid diesters, and tetrathiophosphoric acid diesters, each having two of the above-described hydrocarbon groups having 1 to 30 carbon atoms; phosphoric acid triesters, monothiophosphoric acid triesters, dithiophosphoric acid triesters, trithiophosphoric acid triesters, and tetrathiophosphoric acid triesters, each having three of the above-described hydrocarbon groups having 1 to 30 carbon atoms; and mixtures thereof.

In the present invention, preferably two or more, more preferably three or more, and particularly preferably all of $X^4$ to $X^7$ in formula (4) are oxygen with the objective of further enhancement of high temperature detergency and long drain properties such as oxidation stability and base number retention properties.

Examples of salts of phosphorus compounds represented by formulas (3) and (4) include salts obtained by allowing a metal base such as a metal oxide, a metal hydroxide, a metal carbonate and a metal chloride or a nitrogen-containing compound such as ammonia and an amine compound having in its molecules only a hydrocarbon group having 1 to 30 carbon atoms or a hydroxyl group-containing hydrocarbon group having 1 to 30 carbon atoms to react with a phosphorus compound so as to neutralize part or whole of the remaining acid hydrogen.

Specific examples of the metals of the above-mentioned metal bases include alkali metals such as lithium, sodium, potassium, and cesium, alkaline earth metals such as calcium, magnesium, and barium, and heavy metals such as zinc, copper, iron, lead, nickel, silver, manganese, and molybdenum. Among these metals, preferred are alkaline earth metals such as magnesium and calcium, and zinc.

The above-described metal salts of the phosphorus compounds vary in structure depending on the valence of metals and the number of OH or SH group of the phosphorus compounds. Therefore, no particular limitation is imposed on the structure of the metal salts of the phosphorus compounds. For example, when 1 mol of zinc oxide is reacted with 2 mol of a phosphoric acid monoester (with one OH group), it is assumed that a compound with a structure represented by the formula below is obtained as the main component but polymerized molecules may also exist:

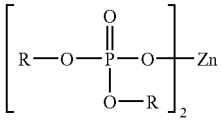

For another example, when 1 mol of zinc oxide is reacted with 1 mol of a phosphoric acid monoester (with two OH groups), it is assumed that a compound with a structure represented by the formula below is obtained as the main component but polymerized molecules may also exist:

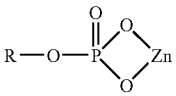

Specific examples of the nitrogen-containing compound include ammonia, monoamines, diamines, and polyamines. More specific examples include alkylamines having a straight-chain or branched alkyl group having 1 to 30 carbon atoms, such as methylamine, ethylamine, propylamine, butylamine, pentylamine, hexylamine, heptylamine, octylamine, nonylamine, decylamine, undecylamine, dodecylamine, tridecylamine, tetradecylamine, pentadecylamine, hexadecylamine, heptadecylamine, octadecylamine, dimethylamine, diethylamine, dipropylamine, dibutylamine, dipentylamine, dihexylamine, diheptylamine, dioctylamine, dinonylamine, didecylamine, diundecylamine, didodecylamine, ditridecylamine, ditetradecylamine, dipentadecylamine, dihexadecylamine, diheptadecylamine, dioctadecylamine, methylethylamine, methylpropylamine, methylbutylamine, ethylpropylamine, ethylbutylamine, and propylbutylamine; alkenylamines having a straight-chain or branched alkenyl group having 2 to 30 carbon atoms, such as ethenylamine, propenylamine, butenylamine, octenylamine, and oleylamine; alkanolamines having a straight-chain or branched alkanol group having 1 to 30 carbon atoms, such as methanolamine, ethanolamine, propanolamine, butanolamine, pentanolamine, hexanolamine, heptanolamine, octanolamine, nonanolamine, methanolethanolamine, methanolpropanolamine, methanolbutanolamine, ethanolpropanolamine, ethanolbutanolamine, and propanolbutanolamine; alkylenediamines having an alkylene group having 1 to 30 carbon atoms, such as methylenediamine, ethylenediamine, propylenediamine, and butylenediamine; polyamines such as diethylenetriamine, triethylenetetramine, tetraethylenepentamine, and pentaethylenehexamine; heterocyclic compounds such as those having an alkyl or alkenyl group having 8 to 20 carbon atoms bonded to the above-exemplified monoamines, diamines and polyamines, specifically undecyldiethylamine, undecyldiethanolamine, dodecyldipropanolamine, oleyldiethanolamine, oleylpropylenediamine, and stearyltetraethylenepentamine and N-hydroxyethyloleylimidazoline; alkyleneoxide adducts thereof; and mixtures thereof.

Among these nitrogen-containing compounds, preferred examples include aliphatic amines having an alkyl or alkenyl group having 10 to 20 carbon atoms, which may be straight-chain or branched, such as decylamine, dodecylamine, tridecylamine, heptadecylamine, octadecylamine, oleylamine, and stearylamine.

Component (B) is preferably at least one type of compound selected from the group consisting of metal salts of phosphorus compounds represented by formula (3) wherein all of $X^1$, $X^2$, and $X^3$ are oxygen and those of phosphorus compounds represented by formula (4) wherein all of $X^4$, $X^5$, $X^6$, and $X^7$ are oxygen with the objective of excellent high temperature detergency, long drain properties such as oxidation stability, and low-friction properties.

Component (B) is more preferably a phosphorus compound represented by formula (4) wherein all of $X^4$, $X^5$, $X^6$, and $X^7$ are oxygen and $R^8$, $R^9$, and $R^{10}$ are each independently a hydrocarbon group having 1 to 30 carbon atoms with the objective of excellent long drain properties such as oxidation stability and high temperature detergency, low-friction properties and a possibility to decrease the ash content.

Component (B) is further more preferably a zinc salt of a phosphorus compound represented by formula (3) wherein two of $X^4$, $X^5$, $X^6$, and $X^7$ are oxygen, two of $R^8$, $R^9$, and $R^{10}$ are hydrocarbon groups having 1 to 30 carbon atoms, and the rest is hydrogen with the objective of excellent anti-wear properties and a possibility to decrease the phosphorus content.

The foregoing becomes apparent by way of referring to the above-mentioned patent applications by the inventor of the present invention.

Among Components (B) described above, preferred are salts of phosphorus acid diesters having two alkyl or aryl groups having 3 to 18 carbon atoms and zinc or calcium; phosphorus acid triesters having three alkyl or aryl groups having 3 to 18 carbon atoms, preferably three alkyl groups having 6 to 12 carbon atoms; salts of phosphoric acid monoesters having one alkyl or aryl group having 3 to 18 carbon atoms and zinc or calcium; salts of phosphoric acid diesters having two alkyl or aryl groups having 3 to 18 carbon atoms and zinc or calcium; and phosphoric acid triesters having three alkyl or aryl groups having 3 to 18 carbon atoms, preferably three alkyl groups having 6 to 12 carbon atoms.

One or more types of compounds among Components (B) may be arbitrarily blended.

When a salt of a dithiophosphorus acid diester having two alkyl or aryl groups having 3 to 18 carbon atoms and zinc is used, the content of the salt can be further decreased to 0.08 percent by mass or less, and further to 0.05 percent by mass or less, in terms of phosphorus based on the total mass of the composition because the salt can maintain anti-wear properties for the valve train of an internal combustion engine well. However, it is most preferred to use a phosphorus-containing anti-wear agent containing no sulfur in the molecules because it can further enhance various characteristic performances such as oxidation stability, high temperature detergency, and low friction properties.

The content of Component (B) in the lubricating oil composition of the present invention is 0.005 percent bymass or more, preferably 0.01 percent bymass or more and particularly preferably 0.02 percent by mass or more, and 0.2 percent bymass or less, preferably 0.1 percent by mass or less and more preferably 0.08 percent by mass or less, in terms of phosphorus based on the total mass of the composition. Component (B) of less than 0.005 percent by mass in terms of phosphorus has no effect on anti-wear properties, while Component (B) of more than 0.2 percent by mass in terms of phosphorus may adversely affect an exhaust-gas after-treatment device.

Components (C) of the lubricating oil composition of the present invention are fatty acid amide compounds represented by formula (2):

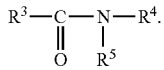

(2)

In formula (2), $R^3$ is a hydrocarbon group having 6 to 40 carbon atoms, and $R^4$ and $R^5$ may be the same or different and are each independently hydrogen or a hydrocarbon group having 1 to 40 carbon atoms.

Although the fatty acid of Component (C) may be straight-chain or branched and saturated or unsaturated fatty acids, the alkyl group or alkenyl group thereof has 6 to 40, preferably 9 to 24, and more preferably 12 to 20 carbon atoms. Fatty acids having an alkyl or alkenyl group of fewer than 6 carbon atoms would deteriorate the solubility of Component (C), while those having an alkyl or alkenyl group of more than 40 carbon atoms would deteriorate the anti-wear properties.

Specific examples of the fatty acid include straight-chain or branched saturated fatty acids, such as heptanoic acid, octanonic acid, nonanoic acid, decanoic acid, undecanoic acid, dodecanoic acid, tridecanoic acid, tetradecanoic acid, pentadecanoic acid, hexadecanoic acid, heptadecanoic acid, octadecanoic acid, nonadecanoic acid, eicosanoic acid, heneicosanoic acid, docosanoic acid, tricosanoic acid, tetracosanoic acid, pentacosanoic acid, hexacosanoic acid, heptacosanoic acid, octacosanoic acid, nonacosanoic acid, and triacontanoic acid; and straight-chain or branched unsaturated fatty acids, such as heptenoic acid, octenoic acid, nonenoic acid, decenoic acid, undecenoic acid, dodecenoic acid, tridecenoic acid, tetradecenoic acid, pentadecenoic acid, hexadecenoic acid, heptadecenoic acid, octadecenoic acid, nonadecenoic acid, eicosenoic acid, heneicosenoic acid, docosenoic acid, tricosenoic acid, tetracosenoic acid, pentacosenoic acid, hexacosenoic acid, heptacosenoic acid, octacosenoic acid, nonacosenoic acid, and triacontenoic acid, the position of which double bonds may vary.

Specific examples of the fatty acid amide for Component (C) include amides obtained by reacting any of the above-exemplified fatty acids or acid chlorides thereof with a nitrogen-containing compound such as ammonia and amine compounds having in the molecules only hydrocarbon or hydroxyl-containing hydrocarbon groups having 1 to 40 carbon atoms.

Specific examples of the nitrogen-containing compound are ammonia; alkylamine, of which the alkyl group may be straight-chain or branched, such as monomethylamine, monoethylamine, monopropylamine, monobutylamine, monopentylamine, monohexylamine, monoheptylamine, monooctylamine, dimethylamine, methylethylamine, diethylamine, methylpropylamine, ethylpropylamine, dipropylamine, methylbutylamine, ethylbutylamine, propylbutylamine, dibutylamine, dipentylamine, dihexylamine, diheptylamine and dioctylamine; alkanolamines, of which the alkanol group may be straight-chain or branched, such as monomethanolamine, monoethanolamine, monopropanolamine, monobutanolamine, monopentanolamine, monohexanolamine, monoheptanolamine, monooctanolamine, monononanolamine, dimethanolamine, methanolethanolamine, diethanolamine, methanolpropanolamine, ethanolpropanolamine, dipropanolamine, methanolbutanolamine, ethanolbutanolamine, propanolbutanolamine, dibutanolamine, dipentanolamine, dihexanolamine, diheptanolamine, and dioctanolamine; and mixtures thereof.

Specific examples of Component (C) include lauric acid amide, lauric acid diethanol amide, lauric acid monopropanol amide, myristic acid amide, myristic acid diethanol amide, myristic acid monopropanol amide, palmitic acid amide, palmitic acid diethanol amide, palmitic acid monopropanol amide, stearic acid amide, stearic acid diethanol amide, stearic acid monopropanol amide, oleic acid amide, oleic acid diethanol amide, oleic acid monopropanol amide, coconut oil fatty acid amide, coconut oil fatty acid diethanol amide, coconut oil fatty acid monopropanol amide, synthetic mixed fatty acid amide having 12 or 13 carbon atoms, synthetic mixed fatty acid diethanol amide having 12 or 13 carbon atoms, and mixtures thereof. Stearic acid amide and oleic acid amide are particularly preferably used because of their excellent anti-wear properties.

The lower limit content of Component (C) is 0.01 percent by mass and preferably 0.05 percent by mass based on the total mass of a composition, while the upper limit content is 1 percent by mass, preferably 0.6 percent by mass, and particularly preferably 0.4 percent by mass based on the total mass of the composition. Component (C) of less than 0.01 percent by mass would fail to improve anti-wear properties while Component (C) of more than 1 percent by mass would deteriorate the storage stability of the resulting composition.

The lubricating oil composition of the present invention has excellent anti-wear properties and can exhibit low-friction properties, high temperature detergency and long drain properties such as base number retention properties and oxidation stability because of the above-described component structure but may contain at least one type selected from the group consisting of (D) ashless dispersants and (E) antioxidants for further improving the characteristic performances of the composition.

Component (D), i.e., ashless dispersant may be any of those used in lubricating oils, such as nitrogen-containing compounds having at least one straight-chain or branched alkyl or alkenyl group having 40 to 400 carbon atoms in the molecules and derivatives thereof, and modified products of alkenyl succinimides. Any one or more of these compounds may be blended.

The carbon number of the alkyl or alkenyl group is preferably 40 to 400 and preferably 60 to 350. An alkyl or alkenyl group having fewer than 40 carbon atoms would deteriorate the solubility of the compound in a lubricating base oil, while an alkyl or alkenyl group having more than 400 carbon atoms would deteriorate the low-temperature fluidity of the resulting lubricating oil composition. The alkyl or alkenyl group may be straight-chain or branched but is preferably a branched alkyl or alkenyl group derived from an oligomer of an olefin such as propylene, 1-butene, and isobutylene or from a cooligomer of ethylene and propylene.

Specific examples of Component (D) include the following compounds one or more of which may be used:

(D-1) succinimides having in their molecules at least one alkyl or alkenyl group having 40 to 400 carbon atoms and derivatives thereof;

(D-2) benzylamines having in their molecules at least one alkyl or alkenyl group having 40 to 400 carbon atoms and derivatives thereof; and (D-3) polyamines having in their molecules at least one alkyl or alkenyl group having 40 to 400 carbon atoms and derivatives thereof.

Specific examples of (D-1) succinimides include compounds represented by formulas (5) and (6):

(5)

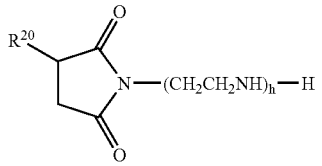

wherein $R^{20}$ is an alkyl or alkenyl group having 40 to 400 and preferably 60 to 350, and h is an integer from 1 to 5, preferably 2 to 4; and (6)

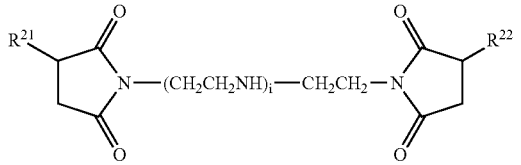

wherein $R^{21}$ and $R^{22}$ are each independently an alkyl or alkenyl group having 40 to 400, preferably 60 to 350 carbon atoms, and particularly preferably a polybutenyl group, and i is an integer from 0 to 4, preferably 1 to 3.

Succinimides include mono-type succinimides wherein a succinic anhydride is added to one end of a polyamine as represented by formula (5) and bis-type succinimides wherein a succinic anhydride is added to both ends of a polyamine as represented by formula (6). The lubricating oil composition may contain either type of the succinimides or mixtures thereof.

No particular limitation is imposed on the method of producing these succinimides. For example, there may be used a method wherein an alkyl or alkenyl succinimide obtained by reacting a compound having an alkyl or alkenyl group having 40 to 400 carbon atoms with maleic anhydride at a temperature of 100 to 200° C. is reacted with a polyamine such as diethylene triamine, triethylene tetramine, tetraethylene pentamine or pentaethylene hexamine.

Specific examples of (D-2) benzylamines include compounds represented by formula (7):

(7)

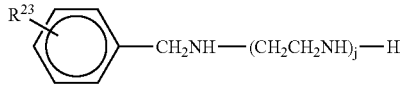

wherein $R^{23}$ is an alkyl or alkenyl group having 40 to 400 and preferably 60 to 350 carbon atoms, and j is an integer from 1 to 5, preferably 2 to 4.

Although no particular limitation is imposed on the method for producing the benzylamines, they may be obtained by reacting a polyolefin such as a propylene oligomer, polybutene, or ethylene-α-olefin copolymer with a phenol so as to obtain an alkylphenol and then subjecting the alkylphenol to Mannich reaction with formaldehyde and a polyamine such as diethylenetriamine, triethylenetetramine, tetraethylenepentamine, or pentaethylenehexamine.

Specific examples of (D-3) polyamines include compounds represented by formula (8):

$$R^{24}\text{-NH—}(CH_2CH_2NH)_k\text{-H} \quad (8)$$

wherein $R^{24}$ is an alkyl or alkenyl group having 40 to 400 and preferably 60 to 350, and k is an integer from 1 to 5 and preferably 2 to 4.

No particular limitation is imposed on the method for producing the polyamines. For example, the polyamines may be produced by chlorinating a polyolefin such as a propylene oligomer, polybutene, or ethylene-α-olefin copolymer and reacting the chlorinated polyolefin with ammonia or a polyamine such as ethylenediamine, diethylenetriamine, triethylenetetramine, tetraethylenepentamine, or pentaethylenehexamine.

Specific examples of the derivatives of the nitrogen-containing compounds exemplified as an example of Component (D) include acid-modified compounds obtained by allowing any of the above-described nitrogen-containing compounds to react with a monocarboxylic acid having 1 to 30 carbon atoms, such as fatty acid; a polycarboxylic acid having 2 to 30 carbon atoms, such as oxalic acid, phthalic acid, trimellitic acid, and pyromellitic acid; or a hydroxy(poly)alkylenecarbonate so as to neutralize or amidize the part or whole of the remaining amino and/or imino groups; boron-modified compounds obtained by allowing any of the above-described nitrogen-containing compounds to react with boric acid so as to neutralize or amidize the part or whole of the remaining amino and/or imino groups; phosphoric acid-modified compounds obtained by allowing any of the above-described nitrogen-containing compounds to react with phosphoric acid so as to neutralize or amidize the part or whole of the remaining amino and/or imino groups; sulfur-modified compounds obtained by allowing any of the above-described nitrogen-containing compounds to react with a sulfuric compound; and modified products obtained by a combination of two or more selected from the acid modification, boron modification, phosphoric acid modification and sulfur modification, of the above-described nitrogen-containing compounds. Among these derivatives, boric acid-modified compounds of alkenylsuccinimides are excellent in heat resistance, anti-oxidation properties and anti-wear properties and thus effective for enhancing the base number retention properties, high temperature detergency and anti-wear properties of the resulting lubricating oil composition.

When the lubricating oil composition of the present invention contains Component (D), the content thereof is from 0.01 to 20 percent by mass and preferably 0.1 to 10 percent by mass based on the total mass of the composition. Component (D) of less than 0.01 percent by mass is less effective in high temperature detergency, while Component (D) of more than 20 percent by mass deteriorates extremely the low temperature fluidity of the resulting lubricating oil composition.

Component (E), i.e., anti-oxidants may be any of phenol-based anti-oxidants, amine-based anti-oxidants, and metal-based anti-oxidants as long as they are generally used in lubricating oils. Addition of an anti-oxidant can enhance the anti-oxidation properties of a lubricating oil composition and thus can enhance the base number retention properties and high temperature detergency thereof.

Examples of the phenol-based anti-oxidants include 4,4'-methylenebis(2,6-di-tert-butylphenol), 4,4'-bis(2,6-di-tert-butylphenol), 4,4'-bis(2-methyl-6-tert-butylphenol), 2,2'-methylenebis(4-ethyl-6-tert-butylphenol), 2,2'-methylenebis(4-methyl-6-tert-butylphenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 2,6-di-tert-butyl-4-methylphenol, 2,6-di-tert-butyl-4-ethylphenol, 2,4-dimethyl-6-tert-butylphenol, 2,6-di-tert-α-dimethylamino-p-cresol, 2,6-di-tert-butyl-4(N,N'-dimethylaminomethylphenol), 4,4'-thiobis(2-methyl-6-tert-butylphenol), 4,4'-thiobis(3-methyl-6-tert-butylphenol), 2,2'-thiobis(4-methyl-6-tert-butylphenol), bis(3-methyl-4-hydroxy-5-tert-butylbenzyl)sulfide, bis(3,5-di-tert-butyl-4-hydroxybenzyl)sulfide, 2,2'-thio-diethylenebis[3-(3,5-di-tert-butyl-4-hydroxyphenyl)propionate], tridecyl-3-(3,5-di-tert-butyl-4-hydroxyphenyl) propionate, pentaerythrityl-tetraquis[3-(3,5-di-tert-butyl-4-hydroxyphenyl)propionate], octyl-3-(3,5-di-tert-butyl-4-hydroxyphenyl) propionate, octadecyl-3-(3,5-di-tert-butyl-4-hydroxyphenyl) propionate, and 3-methyl-5-tert-butyl-4-hydroxyphenyl-substituted fatty acid esters. Mixtures of two or more of these compounds may be used.

Examples of the amine-based anti-oxidants include phenyl-α-naphtylamines, alkylphenyl-α-naphtylamines, and dialkyldiphenylamine. Two or more of these may be mixed.

The phenol-based anti-oxidant and amine-based anti-oxidant may be blended in combination.

When the lubricating oil composition of the present invention contains Component (E), the content thereof is 5 percent by mass or less, preferably 3 percent by mass or less, and more preferably 2.5 percent by mass or less based on the total mass of the composition. Component (E) of more than 5 percent by mass fails to obtain sufficient anti-oxidation properties as balanced with the content. The content of Component (E) is preferably 0.1 percent by mass or more and preferably 1 percent by mass or more in order to further enhance the high temperature detergency and long drain properties such as oxidation stability and base number retention properties during the process of deterioration of a lubricating oil.

In the case of selecting a compound insoluble or less soluble in a lubricating oil, such as zinc dialkylphosphate which is solid at ordinary temperature, from Components (B), it is particularly preferred with the objective of solubility of Component (B) and shortened production time of the resulting lubricating oil composition that the compound be mixed with and dissolved in or reacted with an amine compound such as Component (D), an amine-based anti-oxidant selected from Components (E), or a mixture thereof in an organic solvent such as hexane, toluene, or decalin at a temperature of 15 to 150° C., preferably 30 to 120° C., and particularly preferably 40 to 90° C. for a period of 10 minutes to 5 hours, preferably 20 minutes to 3 hours, and particularly preferably 30 minutes to one hour and blended with a lubricating oil composition as an oil soluble additive after the solvent is vacuum-distilled (see Japanese Patent Application No. 2002-191089).

In order to further enhance the performance characteristics of the lubricating oil composition of the present invention, it may be blended with any of additives which have been used in lubricating oils, depending on purposes. Examples of such additives include metallic detergents other than Components (A) anti-wear agents other than Component (B), friction modifiers, viscosity index improvers, corrosion inhibitors, rust inhibitors, demulsifiers, metal passivators, anti-foaming agents, and dyes.

Examples of metallic detergents other than Component (A) include alkali metal or alkaline earth metal sulfonates and alkali metal or alkaline earth metal phenates.

Examples of anti-wear agents other than Component (B) include sulfur-containing compounds such as disulfides, olefin sulfides, sulfurized fats and oils, and zinc dithiocarbamate. These anti-wear agents may be blended in an amount of 0.005 to 5 percent by mass to an extent that the total sulfur content of the composition is less than the amount as defined by present invention. However, it is preferred that these anti-wear agents not be blended with the objective of decreased sulfur content and long drain properties.

Friction modifiers may be any of compounds which are usually used as friction modifiers for lubricating oils. Examples of such friction modifiers include molybdenum-based friction modifiers such as molybdenum dithiocarbamates, molybdenum dithiophosphate, molybdenumamine complexes, molybdenum-succinimide complexes, and molybdenum disulfide; and ashless friction modifiers such as amine compounds, fatty acid esters, fatty acid amides, fatty acids, aliphatic alcohols, and aliphatic ethers, having at least one alkyl or alkenyl group having 6 to 30 carbon atoms, and particularly preferably straight-chain alkyl or alkenyl group having 6 to 30 carbon atoms in the molecules. These friction modifiers may be blended in an amount of 0.1 to 5 percent by mass. Sulfur-containing molybdenum complexes may be blended within such a range that the total sulfur content of the composition is less than the amount defined by the present invention. The above-described amine compounds and fatty acid esters can not be used instead of Component (C) because they are poorer in anti-wear properties than Component (C). However, they may be used in combination with Component (C) with the objective of further improving the friction reducing effect of the composition of the present invention. They are particularly preferred to the above-described molybdenum friction modifiers because they can further decrease the sulfur, phosphorus and ash contents of the resulting composition.

Examples of viscosity index improvers include non-dispersion type viscosity index improvers such as polymers or copolymers of one or more monomers selected from various methacrylates or hydrides thereof; dispersion type viscosity index improvers such as copolymers of various methacrylates further containing nitrogen compounds; non-dispersion- or dispersion-type ethylene-α-olefin copolymers of which the α-olefin may be propylene, 1-butene, or 1-pentene, or the hydrides thereof; polyisobutylenes or hydrides thereof; styrene-diene hydrogenated copolymers; styrene-maleic anhydride ester copolymers; and polyalkylstyrenes.

It is necessary to select the molecular weight of these viscosity index improvers considering the shear stability thereof. Specifically, the number-average molecular weight of non-dispersion or dispersion type polymethacrylates is from 5,000 to 1,000,000 and preferably from 100,000 to 900,000. The number-average molecular weight of polyisobutylenes or hydrides thereof is from 800 to 5,000 and preferably from 1,000 to 4,000. The number-average molecular weight of ethylene-α-olefin copolymers or hydrides thereof is from 800 to 500,000 and preferably from 3,000 to 200,000.

Among these viscosity index improvers, the use of ethylene-α-olefin copolymers or hydrides thereof is contributive to the production of a lubricating oil composition which is particularly excellent in shear stability. One or more compounds selected from the above-described viscosity index improvers may be blended in an arbitrary amount. The content of the viscosity index improver is generally from 0.1 to 20 percent by mass, based on the total mass of the composition.

Examples of corrosion inhibitors include benzotriazole-, tolyltriazole-, thiadiazole-, and imidazole-based compounds.

Examples of rust inhibitors include petroleum sulfonates, alkylbenzene sulfonates, dinonylnaphthalene sulfonates, alkenylsuccinic acid esters, and polyhydric alcohol esters.

Examples of demulsifiers include polyalkylene glycol-based non-ionic surfactants such as polyoxyethylenealkyl ethers, polyoxyethylenealkylphenyl ethers, and polyoxyethylenealkylnaphthyl ethers.

Examples of metal passivators include imidazolines, pyrimidine derivatives, alkylthiadiazoles, mercaptobenzothiazoles, benzotriazoles and derivatives thereof, 1,3,4-thiadiazolepolysulfide, 1,3,4-thiadiazolyl-2,5-bisdialkyldithiocarbamate, 2-(alkyldithio)benzoimidazole, and β-(o-carboxybenzylthio)propionitrile.

Examples of anti-foaming agents include silicone, fluorosilicone, and fluoroalkyl ethers.

When these additives are blended with the lubricating oil composition of the present invention, the content of each of the corrosion inhibitor, rust inhibitor, and demulsifier is selected from 0.005 to 5 percent by mass based on the total mass of the composition. The content of the metal passivator is selected from 0.005 to 1 percent by mass, while the content of the anti-foaming agent is selected from 0.0005 to 1 percent by mass.

The lubricating oil composition of the present invention is a lubricating oil composition with excellent anti-wear properties, whose sulfur content is 0.3 percent by mass or less and can be rendered a low sulfur lubricating oil composition with excellent anti-wear properties, whose sulfur content can be decreased to 0.2 percent by mass or less, preferably 0.1 percent by mass or less, and more preferably 0.05 percent by mass or less, by selecting properly a lubricating base oil, Components (B), and various additives. The present invention can also provide a lubricating oil composition containing sulfur in an amount of 0.01 percent by mass or less or even 0.005 percent by mass or less or substantially no sulfur.

The sulfated ash content of the lubricating oil composition of the present invention can be decreased to 1.0 percent by mass or less, 0.8 percent by mass or less, further 0.6 percent by mass or less, and particularly 0.5 percent by mass or less by adjusting the content of Component (A) or (B) or other metal-containing additives.

The lubricating oil composition of the present invention is a low sulfur lubricating oil composition which is excellent in not only anti-wear properties but also low friction properties, long drain properties (oxidation stability, base number retention properties) and high temperature detergency and thus can be used preferably for internal combustion engines such as gasoline engines, diesel engines, and gas engines, of motorcycles, automobiles, power generators, and ships. The lubricating oil composition can be suitably used for an internal combustion engine equipped with an exhaust-gas after treatment device by decreasing the sulfur, phosphorus and ash contents. Furthermore, the lubricating oil composition can be used particularly suitably for internal combustion engines, particularly gasoline engines and gas engines, using a low sulfur fuel such as gasoline, gas oil, or kerosene, each of whose sulfur content is 50 ppm by mass or less, preferably 30 ppm by mass or less, and particularly preferably 10 ppm by mass or less, LPG, natural gas, or substantially sulfur-free fuels such as hydrogen, dimethylether, alcohols, and GTL (Gas to Liquid).

Furthermore, the lubricating oil composition can be used suitably as lubricants required to have any of the above-described characteristic performances, such as those for driving systems of automatic or manual transmissions, greases, wet brake oils, hydraulic oils, turbine oils, compressor oils, bearing oils, refrigerating oils, or the like.

APPLICABILITY OF THE INVENTION

The lubricating oil composition of the present invention can exhibit extremely excellent anti-wear properties and can achieve the low contents of sulfur, ash, and phosphorus as well as low friction properties and excellent long drain properties. Therefore, the lubricating oil composition of the present invention can be used not only as a lubricating oil for internal combustion engine but also as those required to have these properties, such as lubricating oils for automatic or manual transmission driving mechanisms, greases, wet brake oils, hydraulic oils, turbine oils, compressor oils, bearing oils, refrigerating oils, or the like.

BEST MODES FOR CARRYING OUT THE INVENTION

Hereinafter, the present invention will be described in more details by way of the following examples and comparative examples, which should not be construed as limiting the scope of the invention.

Examples 1 to 3, and Comparative Examples 1 and 2

Lubricating oil compositions of the present invention (Examples 1 to 3) and those for comparison (Comparative Examples 1 and 2) were prepared as set forth in Table 1 below.

The following performance evaluation test (valve train wear test) was conducted for the resulting compositions.

Valve Train Wear Test

A valve train wear test was conducted in compliance with JASO M 328-95 using a gasoline whose sulfur content is 10 ppm or less, as a test fuel so as to measure the rocker arm pad scuffing area and the wear of the rocker arm and cams after the lapse of 100 hours. The results are also shown in Table 1.

As apparent from the results shown in Table 1, when a monoalkylsalicylate having one secondary alkyl group having 10 or more but fewer than 20 carbon atoms (the component ratio of the 3-alkylsalicylate is 51 percent by mol, i.e., Component (A-1)) was used as Component (A), the compositions even whose metal ratios were 1 and 2.7(Comparative Examples 1 and 2), respectively were excellent in anti-wear properties for rocker arms but insufficient in anti-scuffing properties for rocker arm pads and anti-wear properties for cams unless Component (C) was used.

On the other hand, the lubricating oil compositions of the present invention (Examples 1 to 3) were low sulfur lubricating oil compositions each of whose total sulfur content was 0.3 percent by mass or less. The compositions even whose total sulfur content and phosphorus content were decreased to 0.01 percent by mass or less and 0.08 percent by mass or less, respectively had extremely excellent anti-wear properties (anti-scuffing properties for rocker arm pads and anti-wear properties for rocker arms and cams) due the use of Component (C) in combination. The compositions whose metal ratio of Component (A-1) was 1 and sulfated ash content was 0.5 percent by mass or less (Example 1) and whose metal ratio of Component (A-1) was 5.8 (Example 3) had more excellent anti-wear properties than that whose metal ratio of Component (A-1) was 2.7 (Example 2).

A composition with extremely excellent anti-wear properties can be obtained using Component (A-2), (A-3) or (A-1) having a secondary alkyl group having 20 to 40 carbon atoms even without using Component (C), which Component (A-2), (A-3) or (A-1) can provide a composition which is more excellent in anti-wear properties than those containing Components (A-1) used above and still has sufficient anti-wear properties even though the phosphorus content was made 0.05 percent by mass or less by decreasing the amount of Component (B).

When a sulfur- and phosphorus-containing anti-wear agent such as zinc dithiophosphate is used as Component (B), the resulting compositions would exhibit more excellent anti-wear properties than those of Examples 1 to 3 because the anti-wear agent can maintain anti-wear properties better than a sulfur-free phosphorus-containing anti-wear agent. It is thus assumed that it is possible to obtain a composition decreased in phosphorus content to 0.05 percent by mass or less, total sulfur content to 0.1 percent by mass or less, and sulfated ash content to 0.5 percent by mass or less and having excellent anti-wear properties.

When other Component (B) defined by the present invention, such as a metal-free phosphoric acid triester is used, the resulting composition can be remarkably improved in anti-wear properties and decreased in ash content.

TABLE 1

| | | Example 1 | Example 2 | Example 3 | Comparative Example 1 | Comparative Example 2 |
|---|---|---|---|---|---|---|
| Hydrogenated refined oil [1)] | mass % | balance | balance | balance | balance | balance |
| (A) Calcium salicylate [2)] | mass % | 4 | — | — | 4 | — |
| in terms of metal | mass % | (0.08) | — | — | (0.08) | — |
| (A) Calcium salicylate [3)] | mass % | — | 4 | — | — | 4 |
| in terms of metal | mass % | — | (0.25) | — | — | (0.25) |
| (A) Calcium salicylate [4)] | mass % | — | — | 2.6 | — | — |
| in terms of metal | mass % | — | — | (0.25) | — | — |
| (B) Phosphorus-containing anti-wear agent [5)] | mass % | 0.6 | 0.6 | 0.6 | 0.6 | 0.6 |
| in terms of phosphorus | mass % | (0.078) | (0.078) | (0.078) | (0.078) | (0.078) |
| (C) Oleic acid amide | | 0.3 | 0.3 | 0.3 | — | — |
| (D) Ashless dispersant [6)] | mass % | 5 | 5 | 5 | 5 | 5 |
| (E) Anti-oxidant [7)] | mass % | 2 | 2 | 2 | 2 | 2 |
| Viscosity index improver [8)] | mass % | 4 | 4 | 4 | 4 | 4 |
| Demulsifier [9)] | mass % | 0.01 | 0.01 | 0.01 | 0.01 | 0.01 |
| Total sulfur content | mass % | <0.01 | <0.01 | <0.01 | <0.01 | <0.01 |
| Sulfated ash content | mass % | 0.39 | 0.96 | 0.96 | 0.39 | 0.96 |

TABLE 1-continued

| | | Example 1 | Example 2 | Example 3 | Comparative Example 1 | Comparative Example 2 |
|---|---|---|---|---|---|---|
| JASO valve train wear test | | | | | | |
| Rocker arm scuffing area | % | 5.8 | 30 | 1.7 | 77.5 | 74.6 |
| Rocker arm wear | μm | 2.3 | 1.9 | 1.4 | 5 | 4.7 |
| Cam wear | μm | 2.4 | 20.7 | 1.8 | 31.1 | 39.1 |

1) total aromatic content: 1.2 mass %, sulfur content: 10 mass ppm, kinematic viscosity at 100° C.: 5.6 $mm^2/s$, viscosity index: 125, NOACK evaporation loss: 8 mass %
2) component ratio of salicylic acid: 3-alkylsalicylic acid 51 mol %; 4-alkylsalicylic acid 6 mol %; 5-alkylsalicylic acid 35 mol %; 3,5-dialkylsalicylic acid 7 mol %, 5-alkyl4-hydroxyisophtalic acid 1 mol %, alkyl group: secondary C14, C16, C18, metal ratio: 1, Ca content: 2.0 mass %, sulfated ash: 6.8 mass %
3) component ratio of salicylic acid: 3-alkylsalicylic acid 51 mol %; 4-alkylsalicylic acid 6 mol %; 5-alkylsalicylic acid 35 mol %; 3,5-dialkylsalicylic acid 7 mol %, 5-alkyl4-hydroxyisophtalic acid 1 mol %, alkyl group: secondary C14, C16, C18, metal ratio: 2.7, Ca content: 6.2 mass %, sulfated ash: 21.1 mass %
4) component ratio of salicylic acid: 3-alkylsalicylic acid 51 mol %; 4-alkylsalicylic acid 6 mol %; 5-alkylsalicylic acid 35 mol %; 3,5-dialkylsalicylic acid 7 mol %, 5-alkyl4-hydroxyisophtalic acid 1 mol %, alkyl group: secondary C14, C16, C18, metal ratio: 5.8, Ca content: 9.5 mass %, sulfated ash: 32.3 mass %
5) zinc di(n-butyl)phosphate, phosphorus content: 13.2 mass %, sulfur content: 0 mass %, zinc content: 13.0 mass %, sulfated ash content: 19.5 mass %
6) polybutenylsuccinimide, number-average molecular weight of polybutenyl group: 1,300
7) octyl-3-(3,5-di-tert-butyl-4-hydroxyphenyl)propionate and alkyldiphenyl amine (1:1)
8) OCP, weight average molecular weight: 150,000
9) polyalkylene glycol based

What is claimed is:

1. A lubricating oil composition comprising a lubricating base oil, (A) an alkali metal or alkaline earth metal salicylate containing at least one type of compound selected from those represented by formula (1) below and/or an overbased or basic salt thereof in an amount of 0.005 to 5 percent by mass in terms of metal, (B) a phosphorus-containing anti-wear agent in an amount of 0.005 to 0.2 percent by mass in terms of phosphorus, and (C) an amide compound represented by formula (2) in an amount of 0.01 to 1 percent by mass and containing sulfur in a total amount of 0.3 percent by mass or less, based on the total mass of the composition:

(1)

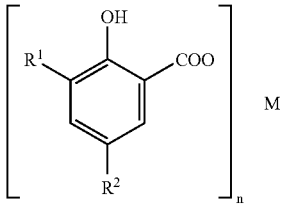

wherein $R^1$ is a hydrocarbon group having 1 to 40 carbon atoms, $R^2$ is hydrogen or a hydrocarbon group having 1 to 40 carbon atoms, which hydrocarbon groups may contain oxygen or nitrogen, M is an alkali metal or alkaline earth metal, and n is an integer of 1 or 2 depending on the valence of the metal; and (2)

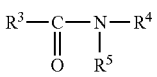

wherein $R^3$ is a hydrocarbon group having 6 to 40 carbon atoms, and $R^4$ and $R^5$ may be the same or different and are each independently hydrogen or a hydrocarbon group having 1 to 40 carbon atoms, wherein Component (B) is a zinc salt of a phosphorus compound of formula (4)

(4)

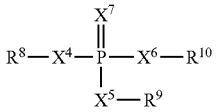

wherein $X^4$, $X^5$, and $X^6$ are each independently oxygen or sulfur, $X^7$ is oxygen, at least one of $X^4$, $X^5$, and $X^6$ is oxygen, and two of $R^8$, $R^9$, and $R^{10}$ are each independently a hydrocarbon group having 1 to 30 carbon atoms and the rest hydrogen, and wherein a sulfated ash content of the lubricating oil composition is 1.0 percent by mass or less.

2. A The lubricating oil composition according to claim 1, wherein component (A) is a dialkylsalicylate represented by formula (1) and/or an overbased or basic salt thereof.

3. The lubricating oil composition according to claim 1 wherein Component (A) is one or a mixture of two or more types of compounds selected from the group consisting of:

(A-1) an alkali metal or alkaline earth metal salicylate wherein the component ratio of the monoalkylsalicylate having one secondary alkyl group having 10 to 40 carbon atoms is 85percent by mol or more wherein the component ratio of a compound represented by formula (1) wherein $R^1$ is a secondary alkyl group having 10 to 40 carbon atoms and $R^2$ is hydrogen is 40 percent by mol or more, and/or an (overbased) basic salt thereof;

(A-2) an alkali metal or alkaline earth metal salicylate represented by formula (1) wherein $R^1$ and $R^2$ are secondary alkyl groups having 10 to 40 carbon atoms, and/or an (overbased) basic salt thereof; and (A-3) an alkali metal or alkaline earth metal salicylate represented by formula (1) wherein either one of $R^1$ or $R^2$ is a hydrocarbon group having one or more but fewer than 10 carbon atoms and the other is a secondary alkyl group having 10 to 40 carbon atoms, and the difference of carbon number between $R^1$ and $R^2$ is 10 or more, and/or an (overbased) basic salt thereof.

4. The lubricating oil composition according to claim 3 wherein the secondary alkyl group having 10 to 40 carbon atoms of Component (A-1) is that having 10 or more but fewer than 20 carbon atoms.

5. The lubricating oil composition according to claim 1 wherein the metal ratio of Component (A) is 2.3 or less.

6. The lubricating oil composition according to claim 1 wherein the metal ratio of Component (A) is 3 or more.

7. The lubricating oil composition according to claim 1 wherein all of $X^4$, $X^5$, $X^6$, and $X^7$ in the formula (4) are oxygen.

8. The lubricating oil composition according to claim 1 wherein it contains Component (B) in an amount of 0.08 percent by mass or less in terms of phosphorus, based on the total mass of the composition.

9. The lubricating oil composition according to claim 1 wherein it contains at least one additive selected from the group consisting of (D) ashless dispersants and (E) anti-oxidants.

10. The lubricating oil composition according to claim 1 wherein the total sulfur content of the lubricating base oil is 0.05 percent by mass or less.

11. The lubricating oil composition according to claim 1 wherein it is used for an internal combustion engine.

12. The lubricating oil composition according to claim 11 wherein it fulfills one or more requirements selected from those wherein the sulfated ash content is 0.5 percent by mass or less, the total sulfur content is 0.05 percent by mass or less, and the phosphorus content is 0.05 percent by mass or less.

13. A method for preventing the valve train of an internal combustion engine from wearing using the lubricating oil composition defined in claim 1

* * * * *